US007183709B2

(12) United States Patent
Moon

(10) Patent No.: US 7,183,709 B2
(45) Date of Patent: Feb. 27, 2007

(54) PLASMA DISPLAY PANEL HAVING ELECTRODES HAVING IDENTICAL PITCH IN THE DISPLAY REGION AND THE TERMINAL REGIONS

(75) Inventor: Cheol-Hee Moon, Cheonan-si (KR)

(73) Assignee: Samsung SDI Co., Ltd, Suwon-si (KR)

( * ) Notice: Subject to any disclaimer, the term of this patent is extended or adjusted under 35 U.S.C. 154(b) by 245 days.

(21) Appl. No.: 10/897,809

(22) Filed: Jul. 24, 2004

(65) Prior Publication Data

US 2005/0023980 A1 Feb. 3, 2005

(30) Foreign Application Priority Data

Jul. 30, 2003 (KR) ..... 10-2003-0052597

(51) Int. Cl.
*H01J 17/49* (2006.01)

(52) U.S. Cl. ..... 313/583; 313/584; 313/585

(58) Field of Classification Search ..... 313/582–587; 345/41

See application file for complete search history.

(56) References Cited

U.S. PATENT DOCUMENTS

2004/0178730 A1* 9/2004 Shinoda et al. ..... 313/582

2004/0239246 A1* 12/2004 Asida et al. ..... 313/582

FOREIGN PATENT DOCUMENTS

JP 11-260266 9/1999

OTHER PUBLICATIONS

Patent Abstracts of Japan for Publication No. 11-260266, date of publication Sep. 24, 1999, in the name of Mori Hiroshi et al.

* cited by examiner

*Primary Examiner*—Joseph Williams
*Assistant Examiner*—Bumsuk Won
(74) *Attorney, Agent, or Firm*—Christie, Parker & Hale, LLP

(57) ABSTRACT

A plasma display panel includes a first substrate and a second substrate opposing one another with a predetermined gap therebetween. Address electrodes are formed on the first substrate. Also, barrier ribs are mounted in the gap between the first substrate and the second substrate, and define discharge cells in a predetermined display region of the first and second substrates. Phosphor layers are formed in the discharge cells. Further, scanning electrodes and display electrodes are formed on the second substrate. The scanning electrodes and the display electrodes each have a pitch in the display region that is identical to a pitch in terminal regions, which are formed to the outside of the display region.

12 Claims, 4 Drawing Sheets

PLASMA DISPLAY PANEL HAVING ELECTRODES HAVING IDENTICAL PITCH IN THE DISPLAY REGION AND THE TERMINAL REGIONS

CROSS-REFERENCE TO RELATED APPLICATIONS

This application claims priority to and the benefit of Korean Patent Application No. 2003-0052597 filed on Jul. 30, 2003 in the Korean Intellectual Property Office, the entire content of which is incorporated herein by reference.

BACKGROUND OF THE INVENTION (a) Field of the Invention

The present invention relates to a plasma display panel (PDP), and more particularly, to an electrode structure of a PDP.

(b) Description of the Related Art

A PDP is a display device in which vacuum ultraviolet rays generated by the discharge of gas in discharge cells excite phosphors to realize predetermined images. As a result of the high resolution possible with PDPs (even with large screen sizes), this flat panel display configuration is quickly emerging as one of the most popular displays.

Depending on how the PDP is driven, this display configuration is classified into the different types of the AC PDP, DC PDP, and combinational PDP. The AC PDP, utilizing a triode surface discharge structure, is increasingly becoming the standard configuration. In this AC PDP, an address electrode, barrier ribs, and a phosphor layer are formed on a rear substrate corresponding to each discharge cell. Also, discharge sustain electrodes realized through scanning electrodes and display electrodes are formed on a front substrate. Discharge gas (typically an Ne—Xe compound gas) is filled in the discharge cells defined by the barrier ribs.

An address voltage is applied between the address electrodes and scanning electrodes to select a discharge cell for illumination, and if a sustain voltage of 150~200V is applied between the scanning electrodes and display electrodes, the discharge gas causes plasma discharge, and vacuum ultraviolet rays are emitted by the plasma discharge. The vacuum ultraviolet rays excite phosphors so that they emit visible light and thereby enable color display.

In the PDP with this structure, the above electrodes are formed each with an end thereof extending into a terminal region, which lies outside a display region. Each of the ends of the electrodes is connected in the terminal region to a connecting element such as a flexible printed circuit (FPCs) or chip on film (COF). Drive voltages needed to effect plasma discharge are applied through such connections.

FIG. 4 is a schematic view of a front substrate of a conventional PDP. The front substrate is shown in a state where scanning electrodes 1 and display electrodes 3 are formed thereon.

Scanning electrodes 1 and display electrodes 3 are formed on front substrate 4 in a stripe pattern along a long axis direction of display region 5 (i.e., along direction X). Further, scanning electrodes 1 and display electrodes 3 are formed alternatingly along a short axis direction of display region 5 (i.e., along direction Y), that is, in a pattern alternating between one scanning electrode 1 and one display electrode 3. Since display electrodes 3 are common electrodes, it is not necessary that a connecting element (for example, an FPC) be connected to each of display electrodes 3. In the case of scanning electrodes 1, however, it is necessary that a connecting element be connected to each of the scanning electrodes 1 and to individually apply a drive signal to the same.

To realize such a connecting structure of scanning electrodes 1, one end 1*a* of scanning electrodes 1 is extended into terminal region 7 formed to the outside of display region 5. Scanning electrodes 1 are separated into groups with a predetermined number thereof in each group, and, within terminal region 7, ends 1*a* of scanning electrodes 1 in each group are positioned at a reduced distance to each other. Therefore, pitch A of scanning electrodes 1 in terminal region 7 is less than pitch B of scanning electrodes 1 in display region 5.

Pitch A of scanning electrodes 1 in terminal region 7 is reduced to prevent interference between the connecting elements when a plurality of connecting elements such as FPCs or COFs is mounted along a short side of front substrate 4, and also to provide spaces for the formation of align marks required when the connecting elements are connected to the terminals of scanning electrodes 1.

However, a drawback of such a configuration of the conventional PDP is that the processes involved in forming the electrodes are made complicated by minimizing the distance between scanning electrodes 1 in terminal region 7. The small distance between scanning electrodes 1 also increases the likelihood that there will be production defects. These problems are of particular concern in PDPs realized using fine pitch panels.

SUMMARY OF THE INVENTION

In one exemplary embodiment of the present invention, there is provided a plasma display panel in which connection between electrodes and connecting elements in a terminal region is made easy without reducing a pitch of electrodes in the terminal region.

In an exemplary embodiment of the present invention, a plasma display panel includes a first substrate and a second substrate opposing one another with a predetermined gap therebetween. Address electrodes are formed on the first substrate. Also, barrier ribs are mounted in the gap between the first substrate and the second substrate, and define discharge cells in a predetermined display region of the first and second substrates. Phosphor layers are formed in the discharge cells. Further, scanning electrodes and display electrodes are formed on the second substrate. The scanning electrodes and the display electrodes each have a pitch in the display region that is identical to a pitch in terminal regions, which are formed to the outside of the display region.

Common terminals connecting ends of the display electrodes and connecting terminals connecting ends of the scanning electrodes are alternatingly formed in the terminal regions, and this alternating pattern is repeated in the terminal regions.

That is, the first substrate and the second substrate are substantially rectangular in shape with long side edges and short side edges, a first terminal region is formed in the second substrate adjacent to one short side edge and extending to the display region, and a second terminal region is formed in the second substrate adjacent to the other short side edge and extending to the display region. The connecting terminals of the scanning electrodes are mounted alternatingly in the first terminal region and the second terminal region along the direction of the short side edges of the second substrate.

In another exemplary embodiment according to the present invention, a third terminal region is formed in the first substrate adjacent to one long side edge and extending to the display region, and a fourth terminal region is formed in the first substrate adjacent to the other long side edge and extending to the display region. The connecting terminals of the address electrodes are mounted alternatingly in the third terminal region and the fourth terminal region in the direction of the long side edges of the first substrate.

DETAILED DESCRIPTION

An exemplary embodiment of the present invention will now be described in detail with reference to the accompanying drawings.

Figure 1:
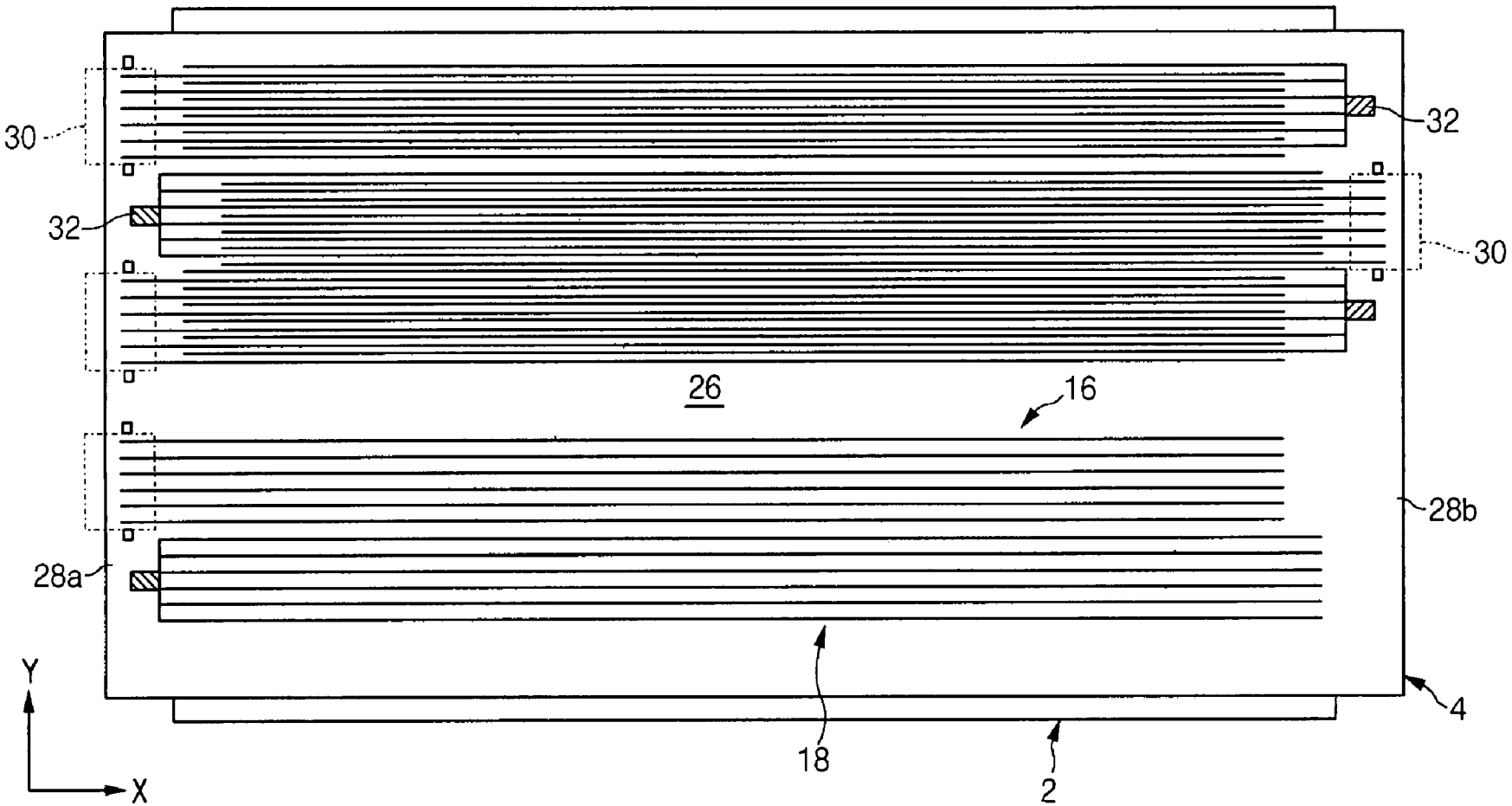
FIG. 1 is a schematic view of a second substrate of a plasma display panel according to an exemplary embodiment of the present invention.
Figure 2:
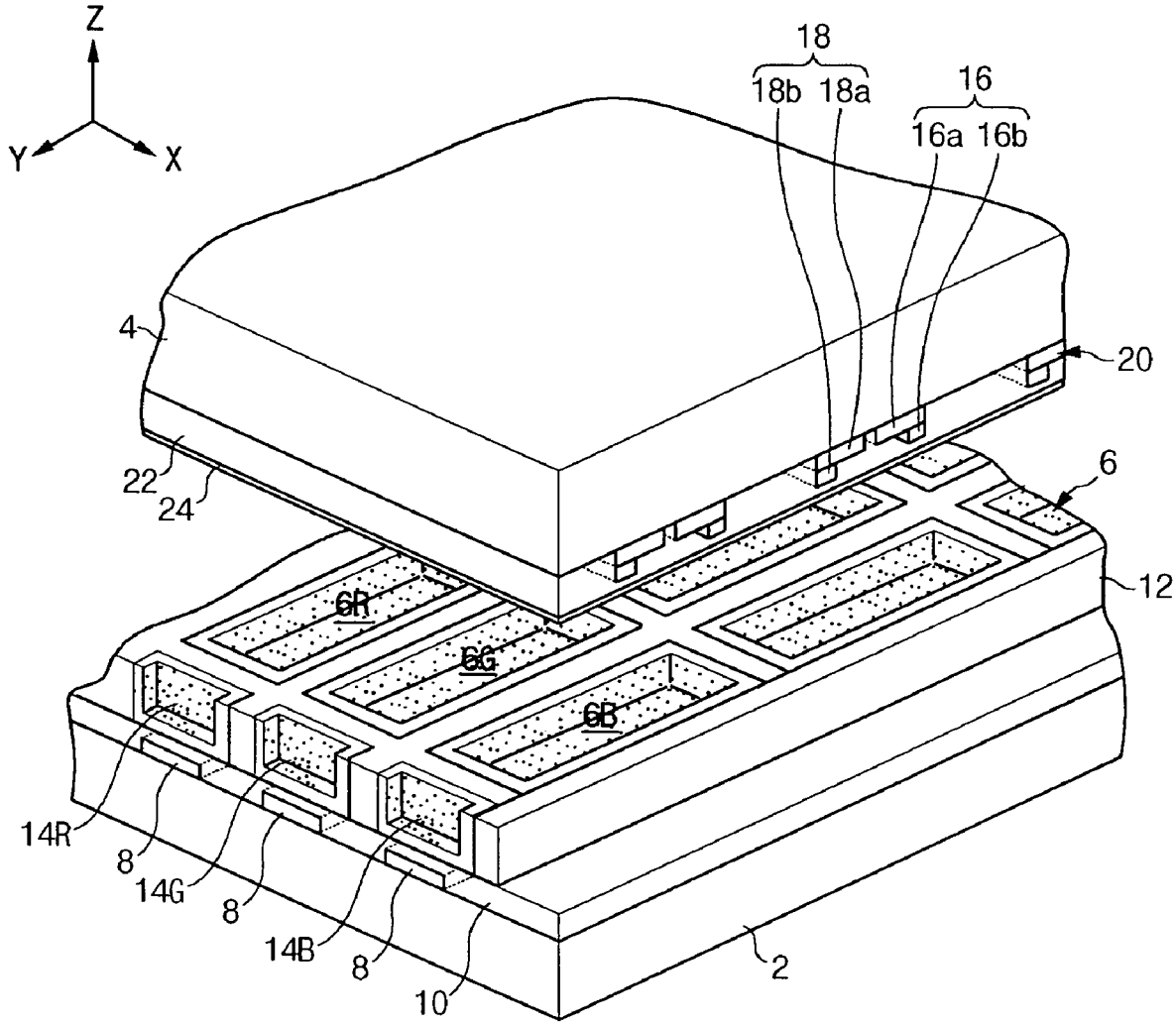
FIG. 2 is a partial exploded perspective view of a plasma display panel according to an exemplary embodiment of the present invention.

With reference to FIGS. 1 and 2, the plasma display panel (PDP) according to an exemplary embodiment of the present invention includes first substrate (or rear substrate) 2 and second substrate (or front substrate) 4. Substrates 2 and 4 are formed in a substantially rectangular shape having long sides and short sides. Hence, the substrates 2 and 4 are defined by long side edges and short side edge. First substrate 2 and second substrate 4 oppose one another and are substantially parallel to one another. Also, substrates 2 and 4 have a predetermined gap therebetween. Discharge cells 6R, 6G, and 6B are formed in the gap between first and second substrates 2 and 4, and visible light for displaying color images is emitted by the independent discharge mechanisms of each of the discharge cells 6R, 6G, and 6B.

In more detail, address electrodes 8 are formed along one direction (direction Y) of first substrate 2 on a surface of the same opposing second substrate 4. As one example, address electrodes 8 are formed uniformly in a stripe pattern and at predetermined intervals. Dielectric layer 10 is formed on first substrate 2 covering address electrodes 8.

Barrier ribs 12 are formed in a lattice pattern on dielectric layer 10 to define discharge cells 6R, 6G, and 6B. Red, green, and blue phosphor layers 14R, 14G, 14B are formed along inner walls of barrier ribs 12 and on a surface of dielectric layers 10 located within discharge cells 6R, 6G, and 6B. Discharge cells 6R, 6G, and 6B defined by barrier ribs 12 are filled with discharge gas (typically an Ne—Xe compound gas). It should be noted that barrier ribs 12 are not limited to the lattice pattern and may be formed in various ways such as in a stripe pattern along the same direction as address electrodes 8.

Discharge sustain electrodes 20 are formed on a surface of second substrate 4 opposing first substrate 2 and along a direction substantially perpendicular to address electrodes 8. Discharge sustain electrodes 20 are comprised of scanning electrodes 16 and display electrodes 18. Transparent dielectric layer 22 is formed covering discharge sustain electrodes 20 over an entire surface of first substrate 2, and MgO protection film 24 is formed covering transparent dielectric layer 22. In this exemplary embodiment, scanning electrodes 16 and display electrodes 18 are realized through transparent electrodes 16*a* and 18*a*, respectively, made of a material such as ITO (indium tin oxide), and bus electrodes 16*b* and 18*b*, respectively, made of a metal such as silver (Ag).

Second substrate 4 includes display region 26, first and second terminal regions 28*a* and 28*b*, and non-display regions (not indicated by a reference numeral). Display region 26 is established in an area that is a predetermined distance from outside edges (the short and long side edges) of second substrate 4 and extends to a center thereof. First and second terminal regions 28*a* and 28*b* are adjacent to opposite short side edges of second substrate 4 and extend from the short side edges to display region 26. The non-display regions are adjacent to the long side edges of second substrate 4 and extend from the long side edges to display region 26.

In the PDP with this structure, scanning electrodes 16 and display electrodes 18 are formed in display region 26 and also extend into terminal regions 28*a* and 28*b*. That is, one end of each of scanning electrodes 16 and one end of each of display electrodes 18 are extended into either first terminal region 28*a* or second terminal region 28*b*, and these ends are connected to connecting elements such as FPCs and COFs. In the exemplary embodiment of the present invention, scanning electrodes 16, each of which is connected to a terminal of a connecting element, are formed having a pitch in terminal regions 28*a* and 28*b* that is identical to a pitch in display region 26.

With reference to FIG. 1, scanning electrodes 16 and display electrodes 18 are formed alternatingly in the short side direction of second substrate 4, that is, in a pattern alternating between one scanning electrode 16 and one display electrode 18 in direction Y. Scanning electrodes 16 and display electrodes 18 are grouped together into units of a predetermined number of scanning electrodes 16 and a predetermined number of display electrodes 18. These units are formed in a repeating, alternating pattern.

For example, for a unit of scanning electrodes 16 and display electrodes 18 closest to one of the long side edges of second substrate 4, one of the ends of scanning electrodes 16 are extended into first terminal region 28*a* and first connecting terminal 30 is mounted to these ends, and one of the ends of display electrodes 18 are extended into second terminal region 28*b* where these ends are interconnected to form common electrode 32. A unit of scanning electrodes 16 and display electrodes 18 adjacent to this unit that is closest to one of the long side edges of second substrate 4 is formed such that one of the ends of the scanning electrodes are extended into second terminal region 28*b* and first connecting terminal 30 is mounted to these ends, and one of the ends of display electrodes 18 are extended into first terminal region 28*a* where these ends are interconnected to form common electrode 32.

This alternating pattern is repeated such that in first terminal region 28*a*, there is an alternating configuration of one of first connecting terminals 30 of scanning electrodes 16 and one of common terminals 32 of display electrodes 18 in the direction of the short sides of second substrate 4 (i.e., along direction Y). Likewise, in second terminal region 28*b*, there is an alternating pattern along direction Y of first connecting terminals 30 of scanning electrodes 16 and common terminals 32 of display electrodes 18. However, there is exactly the opposite alternating pattern of first connecting terminals 30 and common terminals 32 in second terminal region 28*b* as there is in first terminal region 28*a*.

Common terminals 32 of display electrodes 18 are formed to a smaller size than first connecting terminals 30 in first and second terminal regions 28*a* and 28*b* to thereby provide for sufficient room between common electrodes 32. Therefore, it is possible to realize advantages as if a pitch of scanning electrodes 16 is reduced in first and second terminal regions 28*a* and 28*b*. Namely, align marks for compressing first connecting terminals 30 may be formed between the ends of scanning electrodes 16, and interference between first connecting terminals 30 may be avoided. In addition, first connecting terminals 30 of scanning electrodes 16 may be easily mounted, which in turn minimizes the number of electrode defects. Also, performing inspection to check for electrode defects is made easy.

Figure 3:
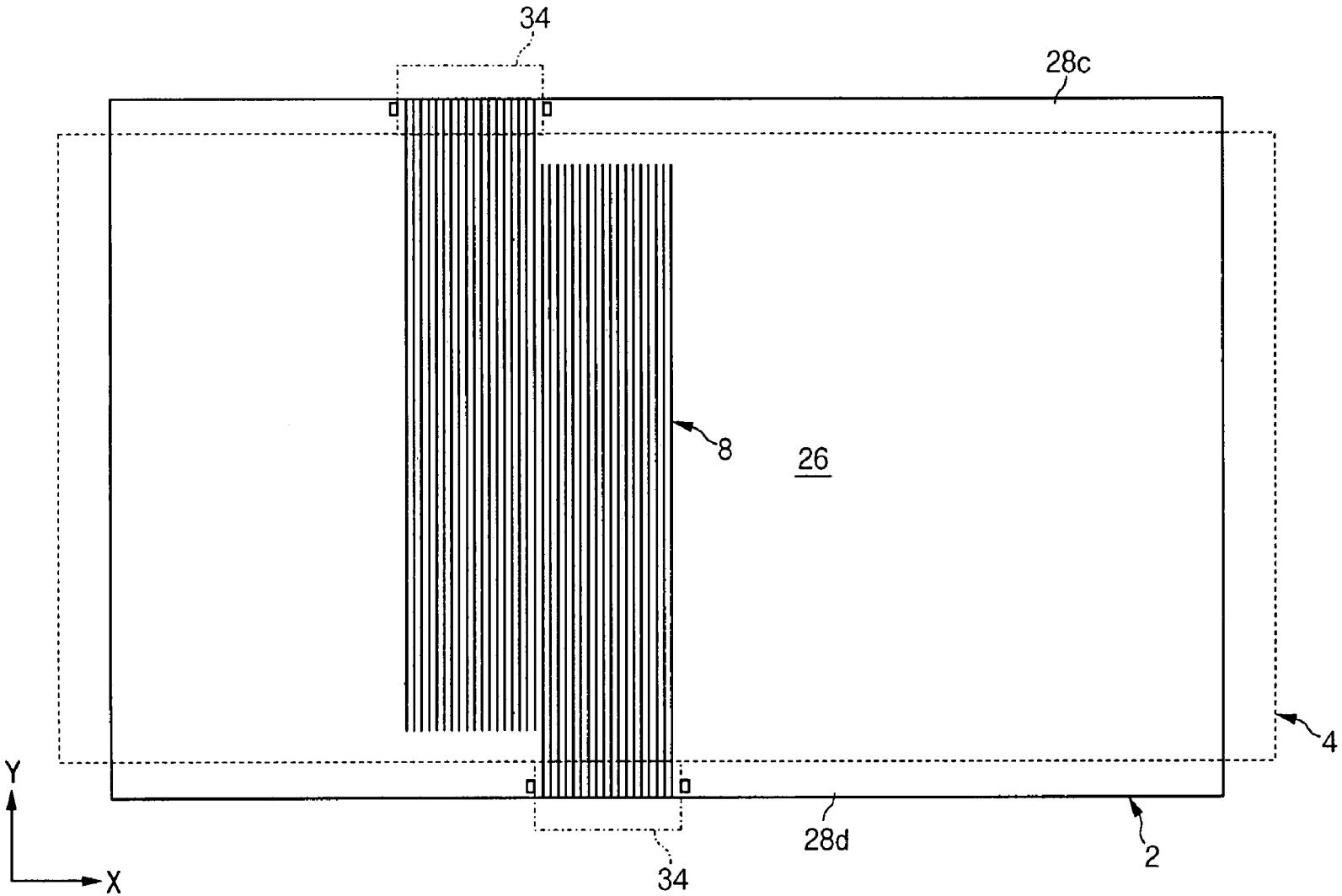
FIG. 3 is a schematic view of a first substrate of a plasma display panel according to an exemplary embodiment of the present invention.
Figure 4:
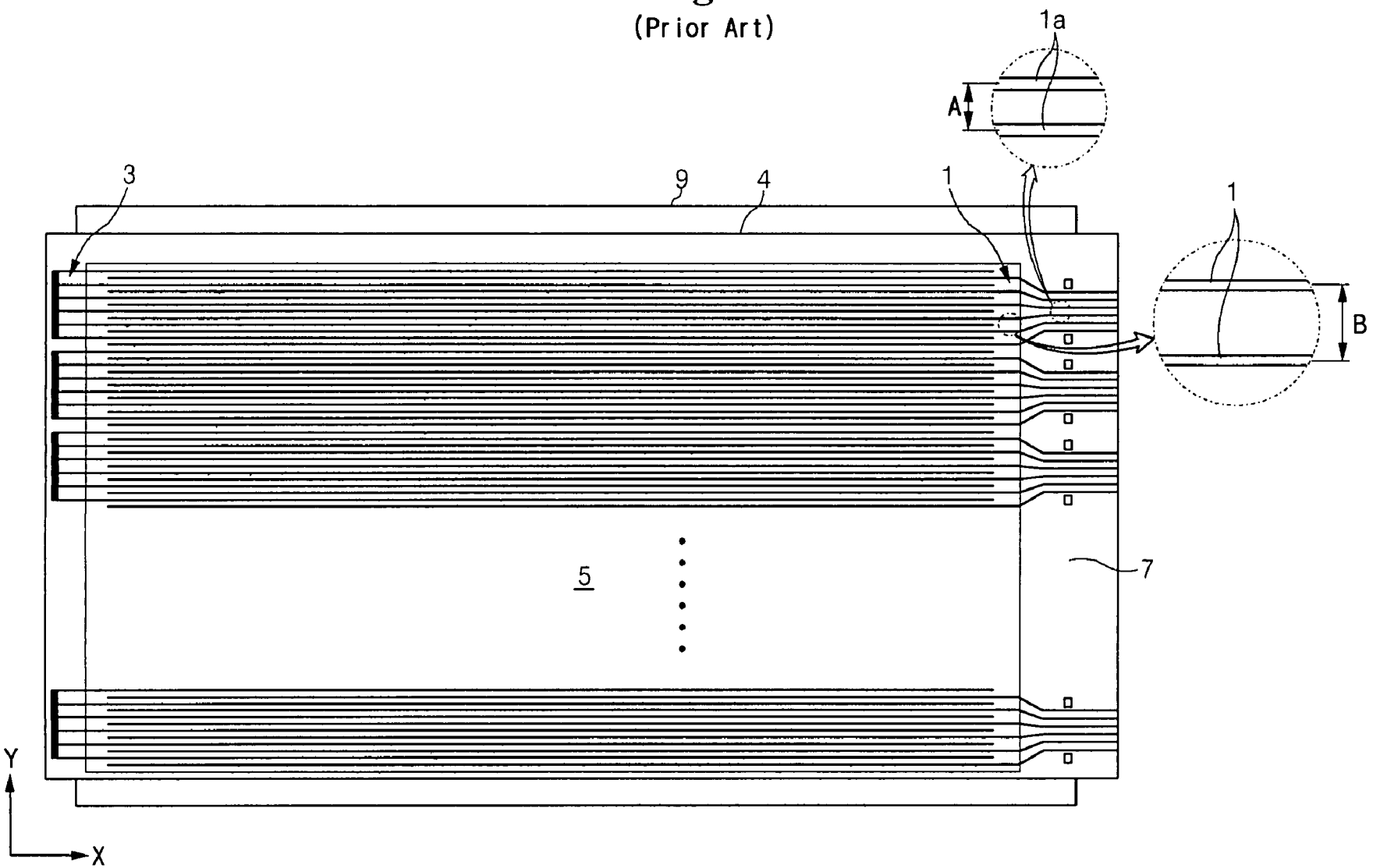
Fig. 4 (Prior Art)
FIG. 4 is a schematic view of a front substrate of a conventional PDP.

The above structure of first connecting terminals 30 of scanning electrodes 16 (or a slight variation thereof) may also be applied to address electrodes 8 formed on first substrate 2. FIG. 3 is a schematic view of first substrate 2.

First substrate 2 shares substantially the same display region 26 with second substrate 4. Also, first substrate 2 includes third and fourth terminal regions 28*c* and 28*d* adjacent to opposite long side edges of first substrate 2 and extending from the long side edges to display region 26, and non-display regions adjacent to the short side edges of the first substrate and extending from the short side edges to display region 26.

As shown in FIG. 3, address electrodes 8 are formed in a stripe pattern extending in the direction of the short sides of first substrate 2 (direction Y) and continuing into either third or fourth terminal regions 28*c* and 28*d*. A pitch of address electrodes 8 in display region 26 is identical to a pitch of address electrodes 8 in third and fourth terminal regions 28*c* and 28*d*.

The address electrodes 8 are grouped together into units of a predetermined number of address electrodes 8. A configuration is used in which one end of address electrodes 8 comprising one unit are extended into third terminal region 28*c*, then one end of address electrodes 8 comprising an adjacent unit are extended into fourth terminal region 28*d*. Such an alternating pattern is repeated. Second connecting terminal 34 is mounted to the ends of each unit of address electrodes 8 in third and fourth terminal regions 28*c* and 28*d*.

By providing sufficient space between ends of address electrodes 8, align marks for compressing second connecting terminals 34 may be formed between the ends of address electrodes 8 without having to reduce a pitch of address electrodes 8 in third and fourth terminal regions 28*c* and 28*d*. This also allows for interference between second connecting terminals 34 to be avoided. Ultimately, mounting of connecting members 34 is made easy.

In the PDP of the exemplary embodiment of the present invention described above, scanning electrodes 16 and display electrodes 18 are formed with the same pitch in both display region 26 and in terminal regions 28*a* and 28*b*. Similarly, address electrodes 8 are formed with the same pitch in both display region 26 and terminal regions 28*c* and 28*d*. Therefore, these electrodes may be easily manufactured through simple processes that use an ink jet, dispenser, or wire electrodes.

By maintaining the same pitch of the scanning electrodes in the terminal regions as in the display region, the processes of manufacturing the electrodes are simplified, electrode defects are minimized, and the detection of electrode defects is made easy. Further, the connecting terminals for the scanning electrodes may be effortlessly mounted.

Although an embodiment of the present invention has been described in detail hereinabove in connection with a certain exemplary embodiment, it should be understood that the invention is not limited to the disclosed exemplary embodiment, but, on the contrary is intended to cover various modifications and/or equivalent arrangements included within the spirit and scope of the present invention, as defined in the appended claims.

What is claimed is:

1. A plasma display panel, comprising:

a first substrate and a second substrate opposing one another with a predetermined gap therebetween;

address electrodes formed on the first substrate;

barrier ribs mounted in the gap between the first substrate and the second substrate, and defining discharge cells in a predetermined display region of the first and second substrates;

phosphor layers formed in the discharge cells; and scanning electrodes and display electrodes alternately formed on the second substrate, wherein the scanning electrodes and the display electrodes each have a pitch in the display region that is identical to a pitch in terminal regions, which are formed to the outside of the display region, wherein each of a plurality of common terminals connects ends of a respective group of display electrodes in the terminal regions and each of a plurality of connecting terminals connects ends of a respective group of scanning electrodes in the terminal regions, and wherein the common terminals alternate with the connecting terminals in the terminal regions.

2. The plasma display panel of claim 1, wherein the first substrate and the second substrate are substantially rectangular in shape with long side edges and short side edges, a first terminal region is formed in the second substrate adjacent to one short side edge and extending to the display region, a second terminal region is formed in the second substrate adjacent to the other short side edge and extending to the display region, and the connecting terminals of the scanning electrodes are mounted alternately in the first terminal region and the second terminal region along the direction of the short side edges of the second substrate.

3. The plasma display panel of claim 2, wherein the common terminals of the display electrodes are mounted alternately in the first terminal region and the second terminal region along the direction of the short side edges of the second substrate.

4. The plasma display panel of claim 1, wherein each of the scanning electrodes and the display electrodes includes a transparent electrode and a metal bus electrode formed on the transparent electrode.

5. A plasma display panel, comprising:

a first substrate and a second substrate opposing one another with a predetermined gap therebetween;

address electrodes formed on the first substrate;

barrier ribs mounted in the gap between the first substrate and the second substrate, and defining discharge cells in a predetermined display region of the first substrate and the second substrate;

phosphor layers formed in the discharge cells; and scanning electrodes and display electrodes formed on the second substrate, wherein the scanning electrodes and the display electrodes each have a pitch in the display region that is identical to a pitch in terminal regions, which are formed to the outside of the display region, and wherein the first substrate and the second substrate are substantially rectangular in shape with long side edges and short side edges, a third terminal region is formed in the first substrate adjacent to one long side edge and extending to the display region, a fourth terminal region is formed in the first substrate adjacent to the other long side edge and extending to the display region, and the connecting terminals of the address electrodes are mounted alternately in the third terminal region and the fourth terminal region in the direction of the long side edges of the first substrate.

6. The plasma display panel of claim 5, wherein common terminals connecting ends of the display electrodes and connecting terminals connecting ends of the scanning electrodes are alternately formed in the direction of the short side edges of the second substrate in the terminal regions, each alternating forming being repeated in the terminal regions.

7. The plasma display panel of claim 6, wherein a first terminal region is formed in the second substrate adjacent to one short side edge and extending to the display region, a second terminal region is formed in the second substrate adjacent to the other short side edge and extending to the display region, and the connecting terminals of the scanning electrodes are mounted alternately in the first terminal region and the second terminal region along the direction of the short side edges of the second substrate.

8. The plasma display panel of claim 7, wherein the common terminals of the display electrodes are mounted alternately in the first terminal region and the second terminal region along the direction of the short side edges of the second substrate.

9. A plasma display panel scanning and display electrode apparatus comprising scanning electrodes and display electrodes formed on a substrate, the substrate having a display region and terminal regions formed to the outside of the display region, the scanning electrodes and the display electrodes each having a pitch in the display region that is identical to a pitch in the terminal regions, wherein common terminals connecting ends of the display electrodes and connecting terminals connecting ends of the scanning electrodes are alternately formed in the terminal regions, each alternating forming being repeated in the terminal regions.

10. The plasma display panel scanning and display electrode apparatus of claim 9, wherein the substrate is substantially rectangular in shape with long side edges and short side edges, a first terminal region being formed in the substrate adjacent to one short side edge and extending to the display region, a second terminal region being formed in the substrate adjacent to the other short side edge and extending to the display region, and the connecting terminals of the scanning electrodes being mounted alternately in the first terminal region and the second terminal region along the direction of the short side edges of the substrate.

11. A plasma display panel address electrode apparatus comprising address electrodes formed on a substrate, the substrate having a display region and terminal regions formed to the outside of the display region, the address electrodes each having a pitch in the display region that is identical to a pitch in the terminal regions, wherein common terminals connecting ends of groups of address electrodes are alternately formed in terminal regions on opposite sides of the display region.

12. The plasma display panel address electrode apparatus of claim 11, wherein the substrate is substantially rectangular in shape with long side edges and short side edges, a first terminal region being formed in the substrate adjacent to one long side edge and extending to the display region, a second terminal region being formed in the substrate adjacent to the other long side edge and extending to the display region, and the connecting terminals of the address electrodes being mounted alternately in the first terminal region and the second terminal region along the direction of the long side edges of the substrate.

* * * * *